US006332335B1

(12) United States Patent
Kajimoto et al.

(10) Patent No.: US 6,332,335 B1
(45) Date of Patent: Dec. 25, 2001

(54) COOLING APPARATUS

(75) Inventors: Takeki Kajimoto; Tsuneo Harukawa, both of Shimizu (JP)

(73) Assignee: K E Corporation Co., Ltd., Shimizu (JP)

( * ) Notice: Subject to any disclaimer, the term of this patent is extended or adjusted under 35 U.S.C. 154(b) by 0 days.

(21) Appl. No.: 09/445,117

(22) PCT Filed: Nov. 28, 1997

(86) PCT No.: PCT/JP97/04346

§ 371 Date: Dec. 2, 1999

§ 102(e) Date: Dec. 2, 1999

(87) PCT Pub. No.: WO98/55810

PCT Pub. Date: Dec. 10, 1998

(30) Foreign Application Priority Data

Jun. 3, 1997 (JP) ..... 9-145020

(51) Int. Cl.[7] ..... F25D 17/02

(52) U.S. Cl. ..... 62/434; 62/270; 62/433; 62/432

(58) Field of Search ..... 62/270, 434, 433, 62/432

(56) References Cited

U.S. PATENT DOCUMENTS 2,346,530 * 4/1944 Wyllie ..... 62/433
3,304,733 * 2/1967 Coffman ..... 62/270
5,381,670 * 1/1995 Tippmann et al. ..... 62/330
5,784,893 * 7/1998 Furuhama et al. ..... 62/333
5,992,169 * 11/1999 Later ..... 62/270
6,062,035 * 5/2000 Ueno ..... 62/324.1
6,067,814 * 5/2000 Imeland ..... 62/384
6,148,634 * 11/2000 Sherwood ..... 62/434
6,158,236 * 12/2000 Viet ..... 62/434

FOREIGN PATENT DOCUMENTS 57031773 2/1982 (JP) .
07000102 1/1995 (JP) .

* cited by examiner

*Primary Examiner*—William Doerrler
*Assistant Examiner*—Mark Shulman
(74) *Attorney, Agent, or Firm*—Price and Gess

(57) ABSTRACT

By supplying a refrigerant utilized for cooling brine at a brine chiller unit (4) to a cooler (21) of a blast chiller (2), the internal space at the blast chiller (2) is cooled. In addition, the brine cooled at the brine chiller unit (4) is supplied to an ice heat storage tank (23) during the night and is supplied to a cold trap (7) during the daytime by switching a three way reversing valve (17). Thus, ice-making and chilled water storage are achieved at the ice heat storage tank (23) during the nighttime so that a tumble chiller (3) performs cooling during the daytime by using the chilled water that has been stored at the ice heat storage tank (23). Consequently, during the daytime, three coolers, i.e., the vacuum cooler (1), the blast chiller (2) and the tumble chiller (3), can be operated with a single brine chiller unit (4).

7 Claims, 1 Drawing Sheet

COOLING APPARATUS

FIELD OF THE INVENTION

The present invention relates to a cooling system for cooling materials such as foods, and, in particular, to a cooling system comprising a plurality of different types of coolers.

BACKGROUND ART

Sanitary management methods adopting the HACCP (Hazard Analysis Critical Control Point) system are beginning to be employed to ensure food safety in various kinds of food industry in recent years. Management items in the HACCP include packaging materials management, ingredient management, cooking and chilling, storage and environment management. In the cooking and chilling aspect of the management system, it has become essential to adopt the so-called Cook-Chill system. The introduction of the Cook-Chill system into meals at schools, companies, hospitals, prisons and the like, and into hotels, restaurants and the like has been deliberated upon and accepted.

In the Cook-Chill system, which is a system for cooking and low temperature storage, food that has been cooked is quickly cooled and then stored over a specific length of time in a chilled (0° C.–3° C.) state until it is reheated immediately before it is served. More specifically, after the food is cooked by applying a heat to raise the temperature at the core of the food to 70° C. or higher for at least two minutes, the cooling process is started within 30 minutes to lower the temperature at the core of the food to 3° C. or lower within 60–90 minutes. This eliminates the risk of the food staying within the temperature range (16° C.–52° C.) over which bacteria in the food are most likely to propagate by passing through this temperature range quickly to reach the safe temperature range. The food that has been rapidly chilled in this manner is then stored in a chilled state within the range of 0° C.–3° C. The food that is taken out of chilled storage is immediately heated to hold a temperature of 70° C. or higher at the core of the food for two minutes or longer.

Now, in the Cook-Chill system described above, different types of cooling rooms for rapidly cooling foods must be provided dependent on the ingredients and the forms of the foods. For instance, foods with a high water content such as cooked noodles including chow mein and udon noodles and side-dishes are rapidly cooled through vacuum cooling at low temperature. In other words, by placing the food to be cooled in a vacuum state, cooling is achieved through the discharge of latent heat by vaporizing the water in the food.

In addition, dishes such as beefsteak and hamburger patties that are put on trays in a chilled state are cooled by employing a blast chiller (forced draft cooler). The blast chiller generates low-temperature air and performs cooling by directly blowing the low-temperature air at high speed with a fan onto the food. Under normal circumstances, a cooling coil is mounted on the ceiling or the like and the low-temperature air is circulated by the fan to blow against the food. Furthermore, cooling achieved through the use of a blast chiller, in which freon or the like that is at a lower temperature than brine is supplied to the cooling coil, is effective when cooling foods that need to be cooled rapidly.

Moreover, liquid foods such as soup that are placed in containers and foods that are packaged in plastic bags or through vacuum packing are cooled in a tumble chiller (chilled water cooling tank) that uses chilled water. In the tumble chiller cooling method, the ice heat storage system is normally adopted. Namely, chilled water is stored in an ice heat storage tank and the chilled water is made to circulate within the cooling tank where a packaged food or the like is stored to be cooled.

However, at facilities such as schools described earlier where the Cook-Chill system is employed, a great number of meals must be prepared each day. Installing a large vacuum cooler, a large blast chiller and a large tumble chiller to meet such broad demand, with a brine cooling means provided at each of them, causes the problem that the entire facility becomes overly large and then a large area is required for the installation of such facilities. In addition, since a heat source device must be provided for each cooler, the production cost and the power consumption will increase.

An object of the present invention, which is proposed to address the problems of the prior art discussed above, is to provide a cooling system that requires a smaller area for installation and achieves reductions in production costs and in power consumption.

SUMMARY OF THE INVENTION

The present invention is a cooling system comprising: means for brine cooling provided with refrigerant circulation means constituting a refrigerating cycle for a refrigerant, that cools brine at said means for refrigerant circulation; a direct cooler that performs cooling by utilizing said refrigerant; means for refrigerant circulation that causes said refrigerant circulating through said refrigerant circulation means to circulate through said direct cooler; a vacuum cooler that achieves a vacuum state for an internal portion thereof to cool said internal portion; means for pressure reduction that reduces the pressure inside said vacuum cooler; means for condensation that takes in water contained in the air inside said vacuum cooler and condenses said water by cooling said water; a first means for brine circulation that causes said brine that has been cooled by said means for brine cooling to circulate through said means for condensation; a chilled water cooler that performs cooling by utilizing chilled water; an ice heat storage tank that stores chilled water that has been cooled by said brine; means for chilled water circulation that causes said chilled water stored at said ice heat storage tank to circulate through said chilled water cooler; a second means for brine circulation that causes said brine that has been cooled at said means for brine cooling to circulate through said ice heat storage tank; and means for switching that switches between said first means for brine circulation and said second means for brine circulation to cause said brine to circulate either through said means for condensation or through a ice heat storage tank According to the present invention, the following advantages are achieved. During a specific period of time such as at nighttime, the means for switching selects the second means for brine circulation as the operating means for circulating brine. Then, the brine that has been cooled by the means for brine cooling is supplied to the ice heat storage tank where the water inside the ice heat storage tank is stored as chilled water.

When the actual cooling operation is performed, such as during the daytime, the means for switching selects the first means for brine circulation as the operating means for circulating brine. This causes the brine to be supplied to the means for condensation. Then, a vacuum state is achieved inside the vacuum cooler by the means for pressure reduction so that some of the water contained in the materials stored inside the vacuum cooler evaporates. This causes the internal temperature of the objects to fall. In addition, the water produced from the objects is taken into the means for condensation and the water thus taken in is cooled and condensed by the brine circulating in the means for condensation.

At the chilled water cooler, cooling is achieved by chilled water stored in the ice heat storage tank which is circulated by the means for chilled water circulation. In addition, the refrigerant circulating in the means for refrigerant circulation of the means for brine cooling circulates inside the direct cooler so that the direct cooler can perform a cooling operation.

As described above, the means for switching performs a switching operation so that the brine cooled by the means for brine cooling is made to circulate through the ice heat storage tank during the night and is made to circulate through the means for condensation during the daytime. In other words, the cooling of the chilled water cooler during the daytime is achieved by using the chilled water that has been stored in the ice heat storage tank during the night. At the same time, by circulating the refrigerant that circulates in the direct cooler to cool the brine through the means for brine cooling, cooling is also achieved by the direct cooler. Consequently, three coolers can be operated by one means for brine cooling. This achieves a reduction in the required installation area for the entire system and, at the same time, achieves reduction in the production cost and in the power consumption.

BEST MODE FOR CARRYING OUT THE INVENTION

Figure 1:
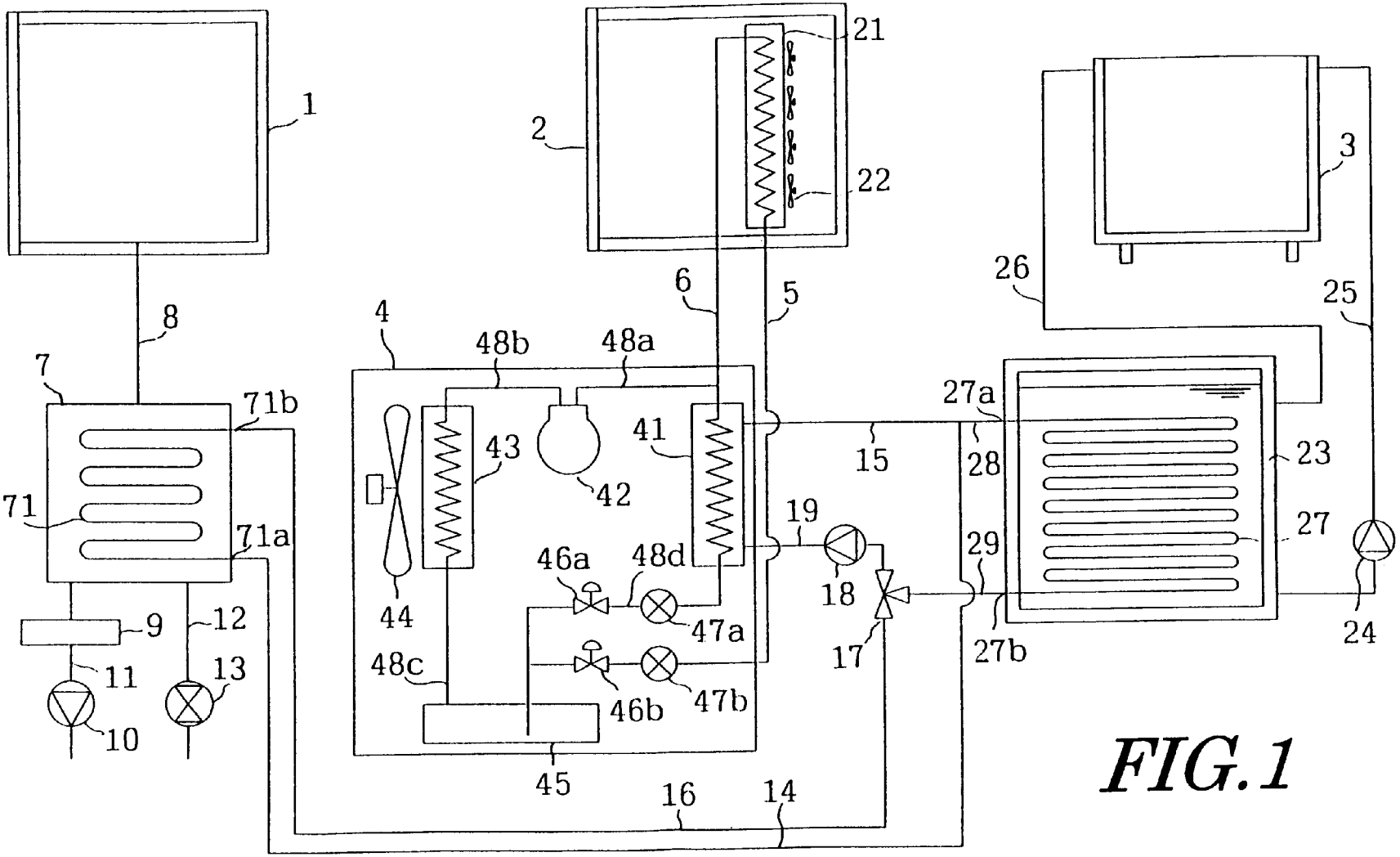
FIG. 1 is a system diagram illustrating the structure of the cooling system in an embodiment of the present invention.

The following is an explanation of an embodiment of the present invention given in reference to the attached drawing.

[1. Structure]

FIG. 1 is a system diagram illustrating the structure of the cooling system in an embodiment of the present invention. In the figure, reference number 1 indicates a vacuum cooler, reference number 2 indicates a blast chiller and reference number 3 indicates a tumble chiller. In this structure, the blast chiller 2 is equivalent to a direct cooler and the tumble chiller 3 is equivalent to the chilled water cooler. It is to be noted that in this embodiment, the vacuum cooler 1, the blast chiller 2 and the tumble chiller 3 each refer to the entire cooling room provided with the corresponding cooler.

Each cooler has a storage space for fruit and vegetables and other foods therein. In more specific terms, a vacuum state is achieved inside the vacuum cooler 1, where foods with high water content such as cooked noodles and side-dishes are stored. In addition, inside the blast chiller 2, precooked foods such as beefsteak and hamburger patties are stored on individual trays or the like. Furthermore, at the tumble chiller 3, which is constituted of a water tank containing chilled water, soup in containers and packaged foods are stored in the chilled water for cooling.

Reference number 4 indicates a brine chiller unit, which is provided as a means for cooling and circulating brine. This brine chiller unit 4 is equivalent to the means for brine cooling. At the brine chiller unit 4, a brine cooler 41, a compressor 42, a condenser 43, a fan 44, a receiver 45, a solenoid valve 46*a,* an expansion valve 47*a* and refrigerant pipings 48*a*–48*d* constitute a freezing cycle. In this structure, freon, for instance, may be used as the refrigerant.

The brine cooler 41 is provided with a cooling coil therein which comes in contact with the brine. At the brine cooler 41, the refrigerant whose pressure has been lowered after traveling through the expansion valve 47*a* takes the heat from the brine at the cooling coil to become refrigerant gas, causing the brine to be cooled. The compressor 42 compresses the refrigerant gas that has been vaporized at the brine cooler 41 until it becomes condensed. The condenser 43 transforms the refrigerant gas compressed in and discharged from the compressor 42 to a low temperature liquid. The fan 44, which is provided to supply low-temperature external air to the condenser 43, is constituted to ensure that with the external air flowing inside the condenser 43, the refrigerant gas is liquefied to become a low temperature refrigerant. Then, the liquefied refrigerant gas is made to flow into the receiver 45. The solenoid valve 46*a* controls the flow of the refrigerant supplied from the receiver 45 to the brine cooler 41.

The refrigerant circulating in the freezing cycle at the brine chiller unit 4 structured as described above is also utilized as a means for cooling the blast chiller 2. A cooler 21 and a fan 22 are provided in the blast chiller 2. A refrigerant supply piping 5 and a refrigerant return piping 6 are mounted at the cooler 21, through which the refrigerant inside the brine chiller unit 4 circulates. In other words, the refrigerant inside the receiver 45 at the brine chiller unit 4 is supplied via a solenoid valve 46*b* and an expansion valve 47*b* provided at the refrigerant supply piping 5. At the cooler 21, the refrigerant whose pressure has been lowered after traveling through the expansion valve 47*b* takes the heat from the surrounding air to become refrigerant gas. The fan 22 blows air that has been cooled at the cooler 21 directly onto food in storage. Then, the refrigerant that has passed through the cooler 21 is made to return to the compressor 42 inside the brine chiller unit 4 through the refrigerant return piping 6. The solenoid valve 46*b,* the expansion valve 47*b,* the refrigerant supply piping 5 and the refrigerant return piping 6 constitute the means for refrigerant circulation.

In addition, the brine that is cooled at the brine cooler 41 of the brine chiller unit 4 is utilized as a means for cooling the vacuum cooler 1 and the tumble chiller 3. The use of the brine as a means for cooling the vacuum cooler 1 is first explained.

In FIG. 1, reference number 7 indicates a cold trap, which is connected to the vacuum cooler 1 equivalent to the cooling room via a vacuum draw piping 8. The cold trap 7 constitutes the means for condensation. In addition, a drain tank 9 and a drain piping 11 mounted with a drain pump 10 are connected to the cold trap 7, and also, a vacuum pump 13 is mounted via a vacuum draw piping 12 to the cold trap 7. The vacuum draw pipings 8 and 12 and the vacuum pump 13 mentioned above constitute the means for pressure reduction.

The vacuum pump 13 achieves a vacuum state inside the vacuum cooler 1 by drawing out the air in the vacuum cooler 1 and causes some of the water contained in the food stored in the vacuum cooler 1 to evaporate. In addition, the cold trap 7 takes in the water that has evaporated from the food inside the vacuum cooler 1 which achieves a vacuum state, via the vacuum draw piping 8 through the suction of the vacuum pump 13. Then, it condenses the water taken in and discharges it to the drain tank 9 as drain. The drain that has been discharged into the drain tank 9 is then discharged via the drain piping 11 by the drain pump 10.

Furthermore, the cold trap 7 is provided with a cooling coil 71 in a serpentine form. One end of the cooling coil 71 constitutes a brine supply port 71*a* with its other end constituting a brine collection port 71*b*. A brine feed piping 14 is provided at the brine supply port 71*a*, with the brine feed piping 14 connected to the brine cooler 41 at the brine chiller unit 4 via a brine feed piping 15. At the brine collection port 71*b*, on the other hand, a brine return piping 16 is provided, which in turn is connected to the brine cooler 41 at the brine chiller unit 4 via a three way reversing valve 17, a brine pump 18 and a brine return piping 19. The brine feed pipings 14 and 15, the brine return pipings 16 and 19 and the brine pump 18 constitute the first means for brine circulation.

Now, the use of the brine as a means for cooling the tumble chiller 3 is explained. In FIG. 1, reference number 23 indicates an ice heat storage tank where chilled water is stored to be supplied to the tumble chiller 3. A chilled water pump 24 and a chilled water supply piping 25 are connected near the bottom surface of the ice heat storage tank 23, and are connected to the tumble chiller 3 so that the chilled water stored in the ice heat storage tank 23 is supplied to the tumble chiller 3. In addition, a chilled water return piping 26 is connected near the water surface in the ice heat storage tank 23 to collect chilled water after it cools the inside of the tumble chiller 3. In other words, at the tumble chiller 3, the chilled water inside the ice heat storage tank 23 circulates. It is to be noted that the chilled water pump 24, the chilled water supply piping 25 and the chilled water return piping 26 described above constitute the means for chilled water circulation.

The ice heat storage tank 23 is provided with an ice-making coil 27 therein in a serpentine form. The end of the ice-making coil 27 near the water surface at the ice heat storage tank 23 constitutes a brine supply port 27*a*, and its end near the bottom surface constitutes a brine collection port 27*b*. A brine feed piping 28 is provided at the brine supply port 27*a*, with the brine feed piping 28 connected to the brine cooler 41 at the brine chiller unit 4 via the brine feed piping 15. A brine return piping 29 is provided at the brine collection port 27*b*, and the brine return piping 29 is connected to the brine cooler 41 at the brine chiller unit 4 via the three way reversing valve 17, the brine pump 18 and the brine return piping 19. The brine feed pipings 15 and 28, the brine return pipings 19 and 29 and the brine pump 18 constitute the second means for brine circulation.

The three way reversing valve 17 switches between the flow path constituted of the brine return pipings 16 and 19 and the flow path constituted of the brine return pipings 29 and 19. This three way reversing valve 17 is equivalent to the means for switching.

[2. Effects]

The operation of the cooling system structured as described above is now explained. First, the operation during the nighttime is explained. Through the switching operation at the three way reversing valve 17, the flow path constituted of the brine return pipings 29 and 19 is opened during the nighttime. Then, when the brine pump 18 operates, the brine that has been cooled down to −6° C.–7° C. at the brine cooler 41 of the brine chiller unit 4 is supplied to the ice-making coil 27 at the ice heat storage tank 23 via the brine feed pipings 15 and 28. At the ice-making coil 27, the brine that has been cooled flows from the brine supply port 27*a* at the upper portion of the ice heat storage tank 23 in a serpentine path in one direction toward the brine collection port 27*b* located at the lower portion until it is collected into the brine chiller unit 4 via the brine return pipings 29 and 19.

While the brine flows in this manner inside the ice-making coil 27, heat exchange occurs between the brine and the water at the external periphery of the ice-making coil 27 and, as a result, ½, for instance, of the water within the ice heat storage tank 23 becomes frozen to form ice at the external periphery of the ice-making coil 27. In addition, the remaining water is stored as chilled water at a temperature of 0° C.

As explained above, during the night when the vacuum cooler 1 is not engaged, the brine that has been cooled by the brine chiller unit 41 of the brine chiller unit 4 is utilized for ice-making and chilled water storage at the ice heat storage tank 23.

Next, the operation during the daytime is explained. Through the switching operation at the three way reversing valve 17, the flow path constituted of the brine return pipings 16 and 19 is opened during the daytime.

First, when cooked noodles, side-dishes and the like that have been cooked through heat application less than 30 minutes prior to storage are stored in the vacuum cooler 1, rapid cooling as described below is performed. Namely, the vacuum pump 13 achieves a vacuum state of up to approximately 4–10 mmHg inside the vacuum cooler 1. This causes some of the water contained in the foods stored in the vacuum cooler 1 to evaporate and the foods are cooled until the core temperature is 15° C. or lower within 10–15 minutes. In addition, the water in the air inside the vacuum cooler 1, which is taken in through the vacuum pump 13, is then drawn into the cold trap 7 via the vacuum draw piping 8. The foods that have been rapidly cooled in this manner are stored in a chilled state within a temperature range of 0° C.–3° C.

Now the brine that has been cooled at the brine chiller unit 4 is supplied to the cooling coil 71 of the cold trap 7 via the brine feed pipings 15 and 14. At the cooling coil 71, the cooled brine flows in a serpentine path from the brine supply port 71*a* toward the brine collection port 71*b* until it is collected into the brine chiller unit 4 via the brine return pipings 16 and 19.

Through this flow of the brine inside the cold trap 7, the water inside the vacuum cooler 1 taken in through the vacuum pump 13 is condensed at the cold trap 7 to be discharged to the drain tank 9 as drain. Subsequently, it is discharged through the drain piping 11 through an operation of the drain pump 10.

Next, when beefsteak, hamburger patties and the like, for instance, that have been cooked through heat application to reach a core temperature of 95° C. are stored inside the blast chiller 2, rapid cooling is achieved as described below. Namely, at the blast chiller unit 4, the refrigerant inside the receiver 45 is supplied to the cooler 21 at the blast chiller 2 through the refrigerant supply piping 5 via the solenoid valve 46*b* and the expansion valve 47*b*. At the cooler 21, the refrigerant takes the heat out of the surrounding air to become refrigerant gas and the air thus cooled is blown onto the foods by the fan 22. The evaporating temperature of the refrigerant at this point is approximately −30° C. and the internal temperature at the blast chiller 2 is lowered to −20° C.

In addition, the refrigerant passing through the cooler 21 is returned to the brine chiller unit 4 via the refrigerant return piping 6. The refrigerant is then supplied to the compressor 42 via the refrigerant piping 48*a*, travels through the refrigerant piping 48*b*, the condenser 43 and the refrigerant piping 48*c* to flow into the receiver 45, thereby circulating between the brine chiller unit 4 and the blast chiller 2.

By implementing this process for 60–90 minutes, the foods are cooled until the core temperature is at 3° C. or lower. The foods that have been rapidly cooled in this manner are then stored in a chilled state at 0° C.–3° C.

Furthermore, when soup placed in containers after it has been cooked through heat application and packaged foods are stored in the tumble chiller 3, rapid cooling is achieved as described below. During this process, chilled water that has been stored in the ice heat storage tank 23 during the night is supplied to the tumble chiller 3. In other words, unlike the vacuum cooler 1 and the blast chiller 2, the tumble chiller 3 is cooled without the use of the brine chiller unit 4 during the daytime.

Thus, through the operation of the chilled water pump 24, the chilled water at 0° C. stored in the ice heat storage tank 23 is supplied to the tumble chiller 3 through the chilled water supply piping 25 provided near the bottom surface of the ice heat storage tank 24. Then, the chilled water that has circulated in the tumble chiller 3 is collected at the ice heat storage tank 23 via the chilled water return piping 26. This sets the temperature of the water inside the tumble chiller 3 to 5° C.

This cooling process is implemented for 60–90 minutes until the core temperature of the foods at 3° C. or lower. The foods that have been rapidly cooled in this manner are then stored in a chilled state at 0° C.–3° C.

As described above, in this embodiment, through the switching control implemented through the three way reversing valve 17, the brine that is cooled at the brine chiller unit 4, is made to circulate at the ice heat storage tank 23 during the nighttime and is made to circulate at the cold trap 7 during the daytime. In addition, during the daytime, the tumble chiller 3 is cooled with the chilled water that has been stored at the ice heat storage tank 23 during the nighttime. At the same time, the blast chiller 2 is cooled by the refrigerant that also cools the brine at the brine chiller unit 4. Consequently, a single brine chiller unit 4 can be employed to simultaneously cool three types of coolers. In other words, even at facilities where a great number of meals must be prepared such as schools and hospitals, the scale of the entire cooling system can be reduced to achieve reductions in production cost and power consumption.

[3. Other embodiments]

It is to be noted that the cooling system according to the present invention is not restricted to the embodiment described above and that the specific shapes of the individual members, and the mounting positions and the mounting methods for the individual members may be varied to suit specific modes of application.

Namely, while the cooling system is explained in reference to the embodiment above as a system for cooling cooked noodles and side-dishes, beefsteak and hamburger patties, soup and the like, the foods to be cooled in the system are not restricted to these examples and the cooling system can be employed to cool any type of food such as, for instance, dairy products, soft drinks, alcohol beverages, tofu and meats. In addition, the cooling system is not only employed for the cooling of foods but for the cooling and for the removal of the reactive heat during the process for manufacturing pharmaceutical products. Therefore, the lengths of cooling times and the internal temperatures and the like at the individual coolers should be adjusted as necessary in correspondence to the types of materials to be stored and their quantities.

In addition, while the brine chiller unit 4 is used only for ice-making at the ice heat storage tank 23 during the nighttime in the embodiment explained earlier, the refrigerant circulating in the brine chiller unit 4 during this process may be also utilized for the cooling operation at the blast chiller 2. This will achieve a 24-hour full time operation at manufacturing plants and the like.

Furthermore, the blast chiller 3 may not be constituted of a water tank, and instead a shower unit may be provided in the cooling room so that chilled water supplied through the chilled water supply piping 25 is injected through the shower portion to cool the inside of the cooling room. Then, the chilled water that has not evaporated may be collected through the chilled water return piping 26.

Moreover, the quantities of the vacuum cooler 1, the blast chiller 2 and the tumble chiller 3 are not restricted to one each and any or all of them may be provided in a plurality.

In addition, the refrigerant used at the brine chiller unit 4 is not restricted to freon and another refrigerant such as ammonia may be utilized, instead.

INDUSTRIAL APPLICABILITY

As has been explained, according to the present invention, a single means for brine cooling can be employed to operate a total of 3 means for cooling that include one means for cooling with a refrigerant and two means for cooling with brine. As a result, a cooling system that only requires a relatively small installation area for the entire system and achieves reductions in production cost and power consumption is provided. In addition, when it is necessary to rapidly cool various forms of foods in large quantities as in the Cook-Chill system, a high degree of efficiency is achieved in the cooling process without having to increase the scale of the entire system.

What is claimed is:

1. A cooling system comprising:

means for brine cooling that cools a brine by a refrigerant circulating in a refrigeration cycle;

a direct cooler that cools a first cooling room by utilizing said refrigerant;

means for refrigerant circulation that causes said refrigerant circulating in said refrigeration cycle to circulate through said direct cooler so that said means for brine cooling can cause said direct cooler to operate;

a vacuum cooler that cools a second cooling room by applying a vacuum to the second cooling room;

means for pressure reduction that reduces the pressure inside said second cooling room;

means for condensation that takes in water contained in the air inside said second cooling room and condenses said water by cooling it;

a first means for brine circulation that causes said brine that has been cooled by said means for brine cooling to circulate through said means for condensation so that the means for brine cooling can cause said vacuum cooler to operate;

a chilled water cooler that cools a third cooling room by utilizing chilled water;

an ice heat storage tank that stores chilled water that has been cooled by said brine;

means for chilled water circulation that causes said chilled water stored in said ice heat storage tank to circulate through said chilled water cooler;

a second means for brine circulation that causes said brine that has been cooled at said means for brine cooling to circulate through said ice heat storage tank so that the means for brine cooling can cause said chilled water cooler to operate; and means for switching that switches between said first means for brine circulation and said second means for brine circulation to cause said brine to circulate either through said means for condensation or through said ice heat storage tank.

2. A cooling system according to claim 1, wherein:

said direct cooler is provided with a direct expansion cooler for cooling air with said refrigerant and a fan for circulating said air.

3. A cooling system according to claim 1, wherein:

said chilled water cooler is constituted of a chilled water cooling tank where chilled water is stored.

4. A cooling system according to claim 2, wherein:

said chilled water cooler is constituted of a chilled water cooling tank where chilled water is stored.

5. A cooling system for rapid cooling of processed food for cold storage at or above freezing, comprising:

a first storage member;

means for applying a vacuum to the first storage member to permit evaporation of liquid from processed food stored in the first storage member;

means for condensing the liquid from the first storage member;

a second storage member;

means for cooling the second storage member;

a third storage member;

a tank member for storing a liquid;

means for applying the liquid from the tank member to the third storage member to cool the third storage member, and a brine chiller unit connected to the means for condensing the liquid to effect a heat exchange to condense the liquid from the first storage member, the brine chiller unit is connected to the means for cooling the second storage member to provide a source of cooling, and the brine chiller unit is connected to the tank member for cooling the liquid whereby one chiller unit can operatively function with each of the respective storage members.

6. A cooling system for rapid cooling of processed food for cold storage at or above freezing, comprising:

a first vacuum storage member;

means for applying a vacuum to the first vacuum storage member to permit evaporation of liquid from processed food stored in the first storage member;

means for condensing the liquid evaporated from the first storage member;

a second cold air storage member;

means for cooling the second cold air storage member;

a third chilled water storage member;

a tank member for storing chilled water;

means for applying the chilled water from the tank member to the third chilled water storage member to cool the third chilled water member; and a brine chiller unit connected to the means for condensing the liquid evaporated from the first vacuum storage member to effect a heat exchange to condense the liquid from the first vacuum storage member with brine, the brine chiller unit is connected to the means for cooling the second cold air storage member to provide a source of cooling, and the brine chiller unit is connected to the tank member for cooling the chilled water; and a switching unit for switching the application of brine between the means for cooling the second cold air storage member and the third chilled water storage member whereby one brine chiller unit can operatively function with each of the respective storage members.

7. A cooling system according to claim 1 wherein the brine chiller unit includes a circulating refrigerant that cools the brine and the circulating refrigerant is controllably provided to the second cold air storage member.

* * * * *